US011193482B2

(12) United States Patent
Ren et al.

(10) Patent No.: US 11,193,482 B2
(45) Date of Patent: Dec. 7, 2021

(54) AIR COMPRESSING APPARATUS AND CONTROL METHOD

(71) Applicant: Hitachi Industrial Equipment Systems Co., Ltd., Tokyo (JP)

(72) Inventors: Zhijia Ren, Tokyo (JP); Yoshiyuki Kanemoto, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 63 days.

(21) Appl. No.: 15/506,407

(22) PCT Filed: Dec. 17, 2014

(86) PCT No.: PCT/JP2014/083325

§ 371 (c)(1),
(2) Date: Feb. 24, 2017

(87) PCT Pub. No.: WO2016/098186

PCT Pub. Date: Jun. 23, 2016

(65) Prior Publication Data

US 2018/0223832 A1 Aug. 9, 2018

(51) Int. Cl.
*F04B 49/20* (2006.01)
*F04B 35/04* (2006.01)
(Continued)

(52) U.S. Cl.
CPC ..... *F04B 49/20* (2013.01); *F04B 35/04* (2013.01); *F04B 41/02* (2013.01); *F04B 49/022* (2013.01);
(Continued)

(58) Field of Classification Search
CPC ..... F04B 49/20; F04B 49/08; F04B 49/022; F04B 2205/05; F04B 2205/063;
(Continued)

(56) References Cited

U.S. PATENT DOCUMENTS 4,068,980 A * 1/1978 Fine ..... F04C 28/06 417/27
4,263,540 A * 4/1981 Brandt ..... F25B 31/02 310/198
(Continued)

FOREIGN PATENT DOCUMENTS

CN 1250868 A 4/2000
CN 1534194 A 10/2004
(Continued)

OTHER PUBLICATIONS

Extended European Search Report issued in counterpart European Application No. 14908396.6 dated May 22, 2018 (10 pages).
(Continued)

*Primary Examiner* — Christopher S Bobish
(74) *Attorney, Agent, or Firm* — Crowell & Moring LLP

(57) ABSTRACT

The purpose of the present invention is to provide an air compressing apparatus capable of establishing a sufficient air-filling rate while reducing noise at the initiation of operations. To solve this problem, in the present invention, the air compressing apparatus comprises a compressor body that compresses air, a motor that drives the compressor body, an inverter that controls the rotation speed of the motor, a control circuit connected to the inverter, and a pressure sensor that detects the pressure of air compressed in the compressor body, wherein the control circuit controls operation of the compressor body by operating at a low speed activation mode that operates the compressor body at a low speed rotational frequency lower than a maximum rotational speed when the air compressing apparatus is activated, and on the basis of a pressure value detected by the pressure sensor and elapsed time from activation, switching from the low speed activation mode to a normal operating mode that
(Continued)

operates at variable frequencies including a maximum rotational frequency.

6 Claims, 13 Drawing Sheets

(51) Int. Cl.
*F04B 49/08* (2006.01)
*F04B 49/02* (2006.01)
*F04B 41/02* (2006.01)
*F04B 49/06* (2006.01)

(52) U.S. Cl.
CPC ..... *F04B 49/065* (2013.01); *F04B 49/08* (2013.01); *F04B 2203/0209* (2013.01); *F04B 2205/05* (2013.01); *F04B 2205/063* (2013.01); *F04B 2207/043* (2013.01)

(58) Field of Classification Search
CPC .. F04B 2207/043; F04B 41/02; F04B 49/065; F04B 2203/0209; F04B 35/04
USPC ..... 417/12, 44.2
See application file for complete search history.

(56) References Cited

U.S. PATENT DOCUMENTS 4,756,669 A * 7/1988 Hata ..... F04B 49/025 417/12
4,863,355 A * 9/1989 Odagiri ..... F04B 41/02 417/12
6,273,936 B1 8/2001 Barry et al.
6,487,869 B1 * 12/2002 Sulc ..... B60H 1/3205 62/228.4
7,017,342 B2 * 3/2006 Iimura ..... F04B 41/02 60/329
7,722,331 B2 * 5/2010 Hirasawa ..... F04B 41/02 417/44.2
8,784,070 B2 * 7/2014 Yokota ..... F04B 41/02 417/44.2
9,017,039 B2 * 4/2015 Toyota ..... F04B 49/022 417/44.2
9,856,875 B2 * 1/2018 Field ..... F04B 49/022
2003/0194325 A1 * 10/2003 Schoenmeyr ..... F04B 49/022 417/32
2004/0191073 A1 * 9/2004 Iimura ..... F04B 41/02 417/44.2
2004/0265132 A1 12/2004 Iimura et al.
2006/0045751 A1 * 3/2006 Beckman ..... F04B 41/02 417/44.2
2010/0178175 A1 7/2010 Koyama
2013/0064684 A1 3/2013 Endou

FOREIGN PATENT DOCUMENTS

JP 63-38693 A 2/1988
JP 9-217682 A 8/1997
JP 2005-214137 A 8/2005
JP 2005-344655 A 12/2005
WO WO 2013/042318 A1 3/2013

OTHER PUBLICATIONS

Chinese-language Office Action issued in counterpart Chinese Application No. 201480081539.2 dated Sep. 11, 2017 (Six (6) pages).
International Search Report (PCT/ISA/210) issued in PCT Application No. PCT/JP2014/083325 dated Apr. 7, 2015 with English translation (3 pages).
Japanese-language Written Opinion (PCT/ISA/237) issued in PCT Application No. PCT/JP2014/083325 dated Apr. 7, 2015 (3 pages).

* cited by examiner

AIR COMPRESSING APPARATUS AND CONTROL METHOD

TECHNICAL FIELD

The present invention relates to an air compressing apparatus that is mounted with an inverter and can control a motor rotation speed, and to a control method.

BACKGROUND ART

As control for an air compressing apparatus, Patent Literature 1 recites: "by comparing the pressure change ΔP with the determination values SL, SH, SW and making determination, the motor control circuit 6 changes the rotational speed of the motor 2 between low rotational speed NL and high rotational speed NH, depending on the determination results; due to this, the rotational speed of the motor 2 can be appropriately controlled in accordance with a flow rate of compressed air consumed from the tank 4, and the energy saving compressor with low noise can be realized" (see ABSTRACT).

CITATION LIST

Patent Literature

PATENT LITERATURE 1: JP-A-2005-214137

SUMMARY OF INVENTION

Technical Problem

Typically, an air compressing apparatus mounted with an inverter operates a motor at the maximum rotation speed at the initiation of operations and fills an external air tank with air. However, the connected air tank has any of various capacities. There is no need to operate at a rotation speed higher than a necessary speed.

Patent Literature 1 discloses detection of change in pressure during operation and switching of motor rotational speed between low rotational speed and high rotational speed. However, this literature does not disclose how to control the apparatus to fill the air tank with air after initiation of operation and to cause the operation to transition to a normal operation.

The present invention has an object to provide an air compressing apparatus capable of establishing a sufficient air-filling rate while reducing noise at the initiation of operations.

Solution to Problem

To solve the above problems, the present invention is an air compressing apparatus, including: a compressor body that compresses air; a motor that drives the compressor body; an inverter that controls a rotation speed of the motor; a control circuit connected to the inverter; and a pressure sensor that detects a pressure of the air compressed by the compressor body, wherein the control circuit controls operation of the compressor body in such a way that when the air compressing apparatus is activated, the compressor body is operated in a low speed activation mode in which the compressor body is operated at a low speed rotational frequency lower than a maximum rotation speed, and based on a pressure value detected by the pressure sensor, elapsed time from activation, a rate of change in pressure and the like, the low speed activation mode is switched to a normal operating mode in which the compressor body is operated at variable frequencies including a maximum rotational frequency.

Advantageous Effects of Invention

The configuration described above can appropriately allow transition to a normal operation while reducing noise at the initiation of operations.

DESCRIPTION OF EMBODIMENTS

Figure 1:
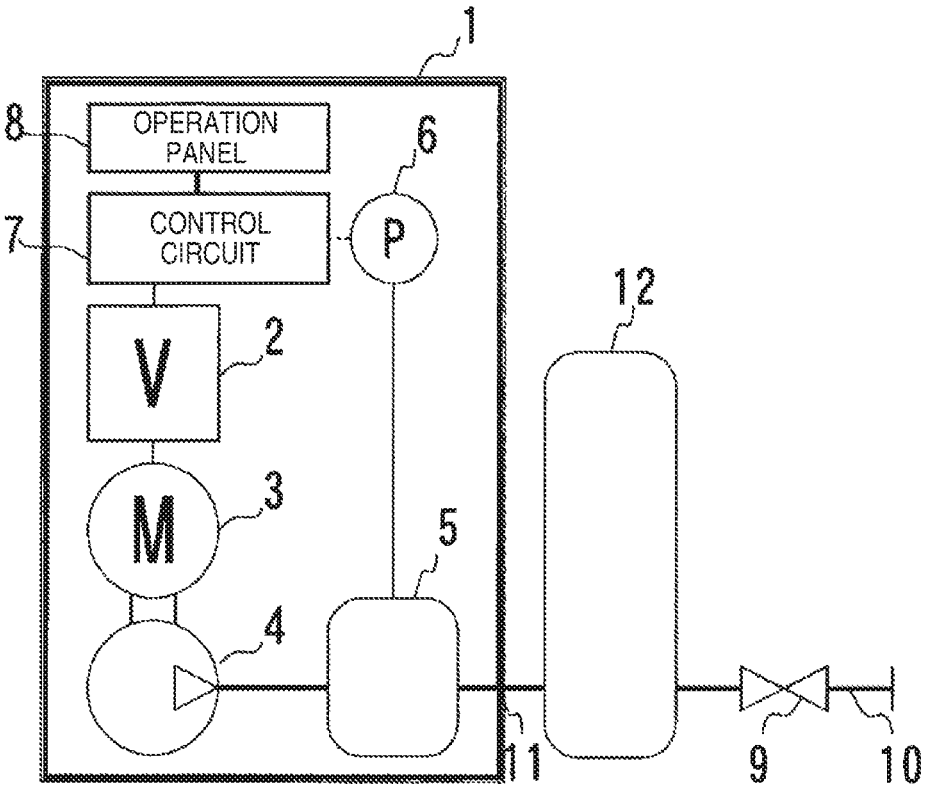
FIG. 1 is a block diagram showing a configuration of an air compressing apparatus according to the present invention.
Figure 2:
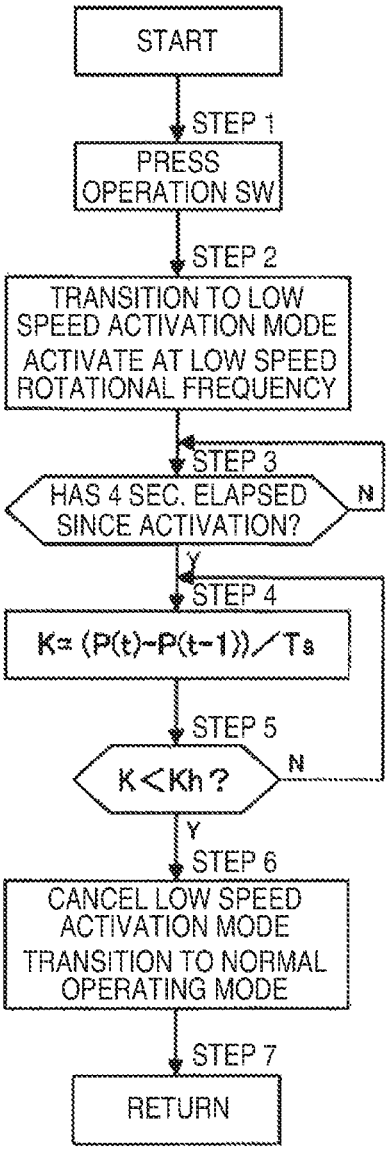
FIG. 2 is a flowchart pertaining to operation mode switching in Embodiment 1.

Embodiment 1 of the present invention is hereinafter described. FIGS. 1 and 2 show a first embodiment.

A compressing apparatus 1 in FIG. 1 mainly includes a compressor body 4, a motor 3 that drives the compressor body 4, an inverter 2 that controls the rotational speed of the motor 3, and an air tank 5 that accumulates compressed air. A pressure sensor 6 that detects the pressure (discharge pressure) in the air tank 5 is attached to the air tank 5. To control the operation, stop and rotational speed of the motor 3, a control circuit 7 is connected to the inverter 2. Air compressed by the compressor body 4 passes through the air tank 5 and piping 11, and is supplied to facilities of a user.

To accumulate compressed air, an external air tank 12 may be provided as a facility of the user, in some cases. The external air tank 12 is allowed to communicate with the air tank 5 of the compressing apparatus 1 through the piping 11. The air tank 5 and the external air tank 12 have the same pressure. The compressed air is supplied to mechanical facilities through a valve 9 and piping 10.

The air tank 5 or 12 may be omitted. In the case where the air tank 5 is omitted, the pressure sensor 6 detects the pressure (discharge pressure) in the piping 11 and the tank 12.

In response to a frequency target value provided by the control circuit 7, the inverter 2 converts a commercial power source (e.g., 60 Hz) into the frequency target value, and supplies this value to the motor 3, thereby controlling the rotational speed of the motor 3. This control can adjust the discharge air rate from the compressor body 4 driven by the motor 3. However, according to the characteristics of the compressor body, the rotation speed can be controlled in a constant range (e.g., 60% to 100% of the commercial power source frequency).

An operation panel 8 is connected to the control circuit 7. The user can perform operation, stop or various settings of the compressing apparatus through buttons and switches on the operation panel 8. The control circuit 7 receives a signal from the operation panel 8, and executes an instruction by the user.

The control circuit 7 stores the pressure value measured by the pressure sensor 6 every predetermined time and a target pressure Pref of the air tank 5 set by the user, and controls the rotation speed of the motor 3 based on the values. In the operation in the normal operating mode, the control circuit 7 calculates a target value of the motor rotation speed so as to allow the pressure of the air tank 5 to be maintained to the predetermined pressure target value Pref, and controls the rotation speed of the motor 3 through the inverter 2. When the detected pressure is in a predetermined range with respect to the pressure target value Pref (e.g.: within Pref±0.05 MPa), the rotation speed of the motor 3 is adjusted so that the detected pressure is held at the pressure target value Pref. On the other hand, when the detected pressure exceeds the upper limit of the predetermined range (e.g.: Pref+0.05 MPa or higher), the operation is controlled to have the minimum rotation speed. When the detected pressure does not reach the lower limit of the predetermined range, the operation is controlled to be performed at the maximum rotation speed.

The compressing apparatus 1 according to the Embodiment 1 has the configuration as described above. Next, referring to FIGS. 2 and 3, control of the compressing apparatus 1 through use of a pressure measurement value P(t) is described.

Figure 3:
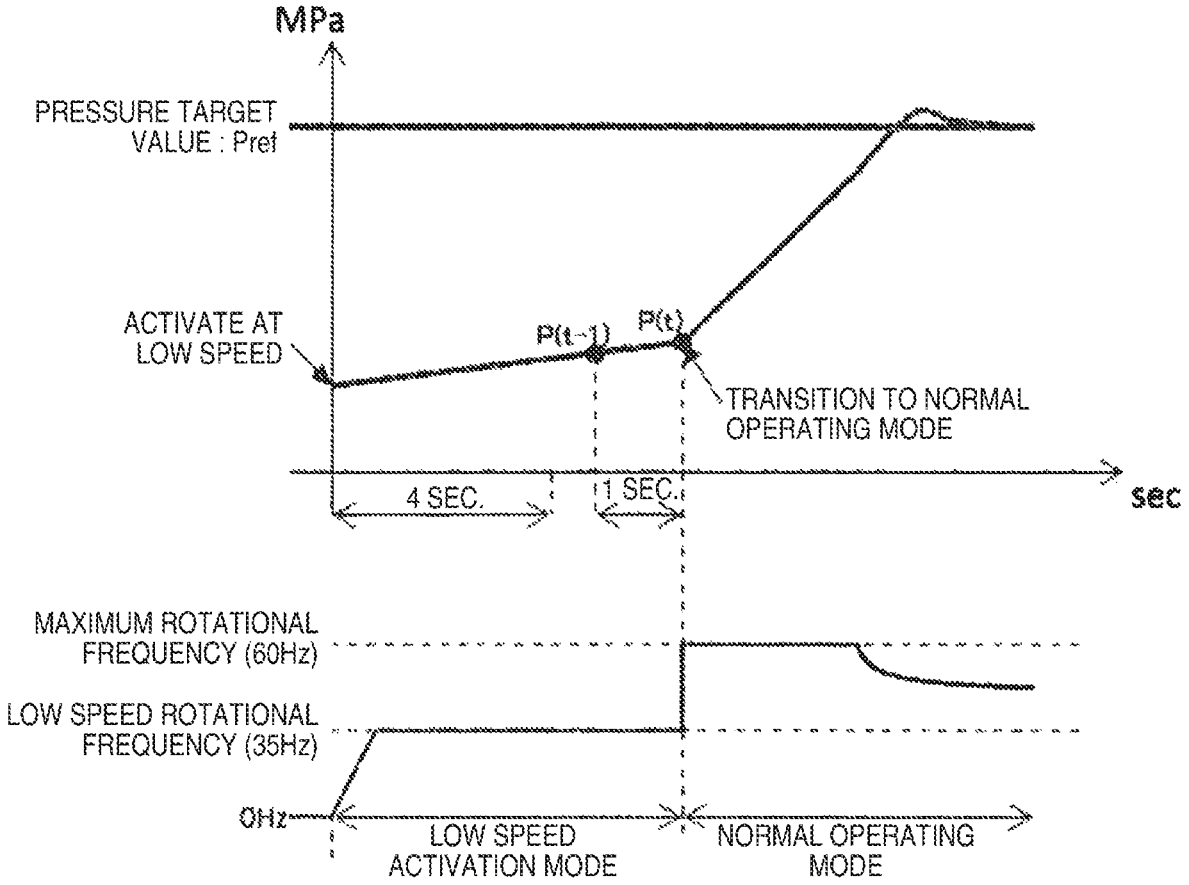
FIG. 3 is a diagram showing change in pressure and operation rate of the compressing apparatus at the initiation of operations in Embodiment 1.

FIG. 2 shows a control flow of switching from a low speed activation mode to a normal operating mode at the time of activation of the compressing apparatus 1. FIG. 3 shows change in pressure with respect to the pressure target value Pref and change in the operation rate (operation mode) of the compressing apparatus from activation of the compressing apparatus 1 to transition to the normal operating mode.

In step 1, the user presses an operation SW to activate the compressing apparatus 1. In step 2, the operation transitions to the low speed activation mode after activation, and the compressor body 4 is activated at a low rotational frequency (e.g., the minimum rotational frequency 35 Hz). The low speed activation mode is a mode of operation at a low rotational frequency (the rotational frequency in consideration of balance between noise and compression efficiency; e.g., 35 Hz) operable as the compressing apparatus irrespective of the target pressure value Pref and the current pressure value. Compared with the operation at a high rotational frequency, noise can be reduced. Due to the performance of the inverter, a constant time (e.g., four seconds) is required after activation until the target frequency is reached. Consequently, in step 3, the processing is prevented from transitioning to the next step until the constant time (e.g., four seconds) elapses after activation. After the constant time (e.g., four seconds) has elapsed, the increasing gradient of the pressure becomes stable. Consequently, the processing transitions to step 4. In step 4, the control circuit 7 calculates the pressure increasing rate K according to (Expression 1) using a value obtained from the pressure sensor 6.

$$K=(P(t)-P(t-1))/Ts \quad \text{(Expression 1)}$$

Here, K: pressure increasing rate, P(t): current pressure value, P(t−1): pressure value one sec. before. Ts: 1 sec.

In step 5, the control circuit 7 determines whether the calculated pressure increasing rate K is lower than a predetermined increasing rate threshold Kh. When it is determined as "Yes", the processing transitions to step 6. When it is determined as "No", the low speed operation is continued because the rate of filling to the air tank 5 is determined to be sufficient. In this case, after the constant time has elapsed, the processing returns to step 4, the pressure increasing rate K is obtained again according to (Expression 1) and determination is performed again in step 5.

When it is determined as "Yes" in step 5, it is indicated that the pressure increasing rate K is lower than the increasing rate threshold Kh and the filling rate is insufficient. Consequently, in step 6, the low speed activation mode is canceled and the operation transitions to the normal operating mode. Finally, the processing transitions to step 7, and returns.

Immediately after transition to the normal operating mode, as shown in FIG. 3, the pressure is not in a predetermined pressure range with respect to the target pressure value Pref. Consequently, the motor rotation speed is adjusted so as to operate at the maximum rotational frequency for a time and allow the pressure to track the target value Pref as the target value Pref is approached.

In Embodiment 1, operation in the low speed activation mode at the time of activation allows noise to be reduced. In a case where the tank capacity of the facility of the user is small and high speed operation is not required, operation is allowed in the low speed activation mode from start to end until completion of tank filling. On the other hand, in a case where the tank capacity is large and filling with air at the low speed operation is determined to be slow, the operation is automatically switched to the normal operating mode. Consequently, no trouble occurs also in view of the filling rate.

The pressure increasing rate K is calculated at a constant frequency (e.g., one second), thereby allowing the pressure increasing rate to be always monitored. Thus, for example, even in a case where start of the user's use of air in the midway of filling the tank with air at the time of activation alleviates increase in pressure or reduces the pressure, the operation can be immediately switched automatically to the normal operating mode.

As described above, without preliminary setting on the user side, the low speed operation or the normal operation is automatically selected according to the capacity of the external air tank 12 of the user's facility. Consequently, reduction in noise can be achieved to the greatest extent while securing the tank filling rate.

In this embodiment, for example, the rotation speed (frequency) at the time of activation is set to the minimum rotation speed (frequency). According to certain characteristics of a compressing apparatus, the noise in the operation at the minimum rotation speed is not necessarily the minimum. Consequently, the rotation speed (frequency) at the time of activation may be set in consideration of the characteristics, such as noise and vibrations.

The low speed activation mode can be set to be enabled or disabled through the operation panel 8. A user without need of the low speed activation mode can operate in the normal operating mode from the time of activation of the compressing apparatus by disabling the function through button operation.

Next, Embodiment 2 of the present invention is hereinafter described. Embodiment 2 assumes a compressing apparatus 1 having a configuration analogous to that of Embodiment 1 described above. The same configuration elements are assigned the same signs. Description of the analogous elements is omitted.

Figure 4:
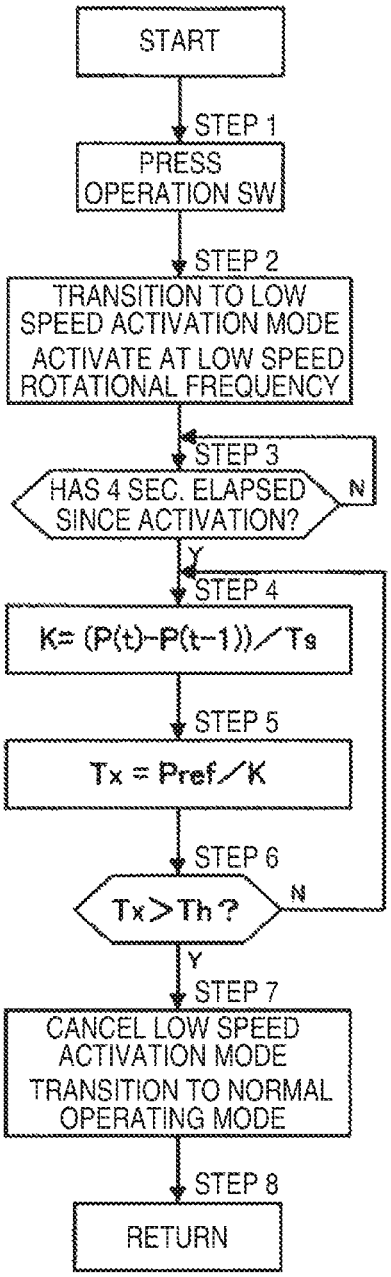
FIG. 4 is a flowchart pertaining to operation mode switching in Embodiment 2.
Figure 5:
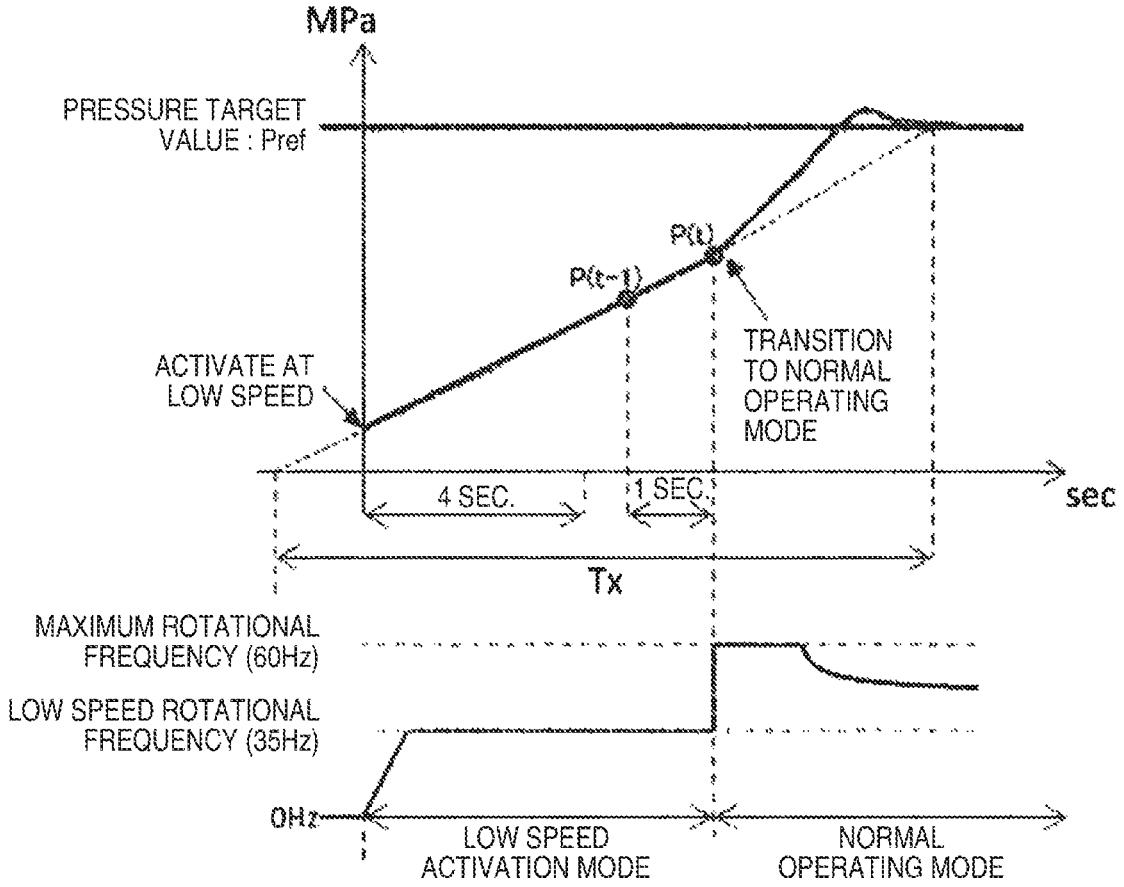
FIG. 5 is a diagram showing change in pressure and operation rate of the compressing apparatus at the initiation of operations in Embodiment 2.

FIG. 4 shows a control flow of switching from the low speed activation mode to the normal operating mode at the time of activation of the compressing apparatus 1. FIG. 5 shows change in pressure with respect to the pressure target value Pref and change in the operation rate (operation mode) of the compressing apparatus from activation of the compressing apparatus 1 to transition to the normal operating mode.

In step 1, the operation SW is pressed to activate the compressing apparatus 1. In step 2, the operation transitions to the low speed activation mode, and the compressor body 4 is activated at a low rotational frequency (e.g., the minimum rotational frequency 35 Hz). Due to the performance of the inverter, a constant time (e.g., four seconds) is required after activation until the target frequency is reached. Consequently, in step 3, the processing is prevented from transitioning to the next process until the constant time (e.g., four seconds) elapses after activation. After the constant time (e.g., four seconds) has elapsed, the increasing gradient of the pressure becomes stable. Consequently, the processing transitions to step 4. In step 4, the pressure increasing rate K is calculated using (Expression 1) described above.

In step 5, the control circuit 7 calculates an estimated filling time Tx required for the tank pressure to reach the target value Pref from 0 MPa using the increasing rate K calculated in step 4. The calculation expression is shown in (Expression 2).

$$Tx = Pref/K \quad \text{(Expression 2)}$$

In step 6, the control circuit 7 determines whether the estimated filling time Tx exceeds the preliminarily provided threshold Th. The threshold Th is a target filling time, and can be preset by the user through the operation panel 8. When it is determined as "No", the low speed operation mode is continued, the processing returns to step 4, and the rate of change in pressure is confirmed again. When it is determined as "Yes" in step 6, the processing transitions to step 7, the low speed activation mode is canceled, and the operation transitions to the normal operating mode.

That is, when Tx is higher than Th, it is indicated that filling cannot be completed within the target filling time Th. Consequently, the motor rotation speed is adjusted so as to cause the operation to transition to the normal operating mode, operate at the maximum rotational frequency for a time and allow the pressure to track the target value Pref as the target value Pref is approached.

In step 8, the processing returns. According to the flow, the compressing apparatus 1 operates in the low speed operation mode at the time of activation, and the operation transitions to the normal operating mode in the midstream.

As with Embodiment 1, Embodiment 2 can achieve low noise at the time of activation and secure a sufficient air-filling rate to the tank in a manner compatible with each other. To cause the target filling time set by the user to be the threshold for switching between the low speed operation mode and the normal operating mode, the intention of the user can be reflected in the control of the compressing apparatus 1.

Figure 6:
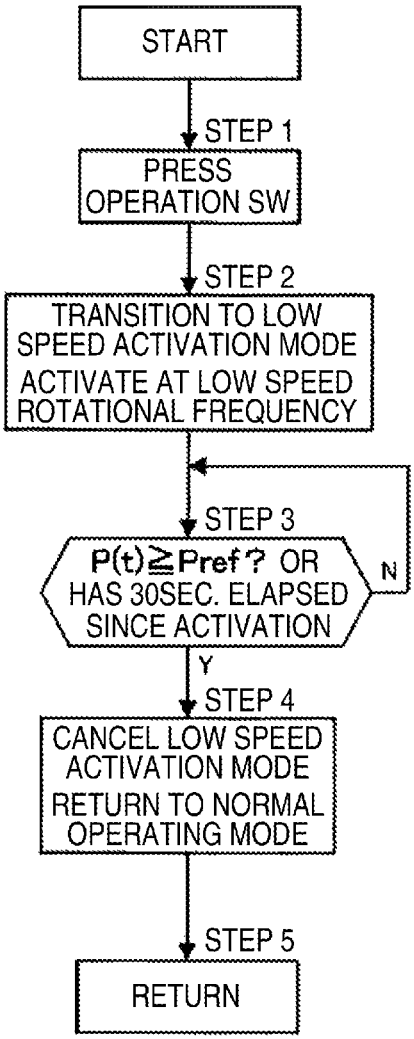
FIG. 6 is a flowchart pertaining to operation mode switching in Embodiment 3.
Figure 7:
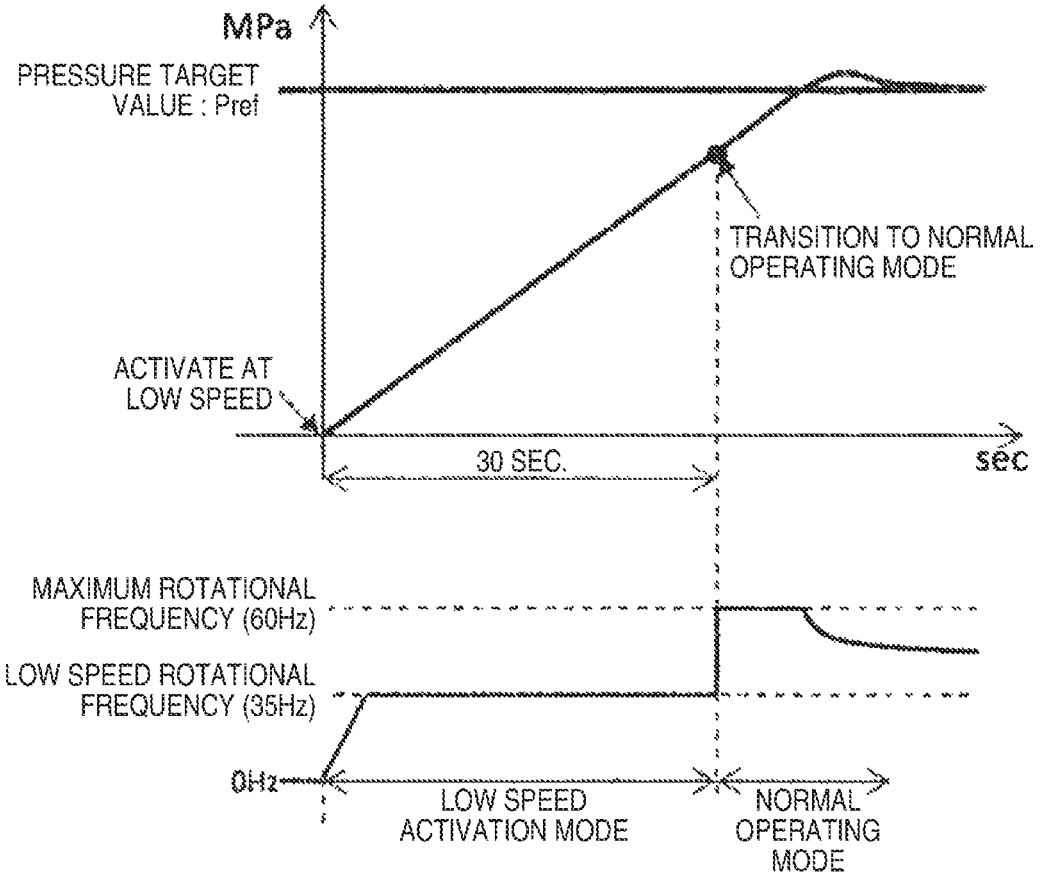
FIG. 7 is a diagram showing change in pressure and operation rate of the compressing apparatus at the initiation of operations in Embodiment 3.

Next, Embodiment 3 of the present invention is hereinafter described. Embodiment 3 assumes a compressing apparatus 1 having a configuration analogous to that of Embodiment 1. The same configuration elements are assigned the same signs. Description of the analogous elements is omitted. FIG. 6 shows a control flow of switching from the low speed activation mode to the normal operating mode at the time of activation of the compressing apparatus 1. FIG. 7 shows change in pressure with respect to the pressure target value Pref and change in the operation rate (operation mode) of the compressing apparatus from activation of the compressing apparatus 1 to transition to the normal operating mode.

In step 1, the operation SW is pressed to activate the compressing apparatus 1. In next step 2, the operation transitions to the low speed activation mode, and the compressor body 4 is activated at a low rotational frequency (e.g., the minimum rotational frequency 35 Hz). In step 3, it is determined whether a constant time (e.g., 30 seconds) has elapsed from activation or the pressure reaches at least the pressure target value Pref. When it is determined as "Yes", the processing transitions to step 4, the low speed activation mode is canceled, and the operation returns to the normal operating mode. When it is determined as "No", the processing returns to step 3 again after a constant time e.g., one second) has elapsed, and the pressure and time are confirmed.

According to the flow of FIG. 6, the compressing apparatus 1 operates in the low speed operation mode at the time of activation, and the operation transitions to the normal operating mode in the midstream.

In Embodiment 3, unless the pressure target value Pref is reached after activation of the compressing apparatus, the operation allowed in the low speed operation mode for a constant time. In comparison with the other embodiments, there are advantages that the method of determining the operation mode switching is simple and implementation is easily achieved.

As to the pressure target value here, even when the pressure reaches a predetermined range (e.g.: within Pref±5%), it may be construed that the pressure reaches the pressure target value Pref.

Figure 8:
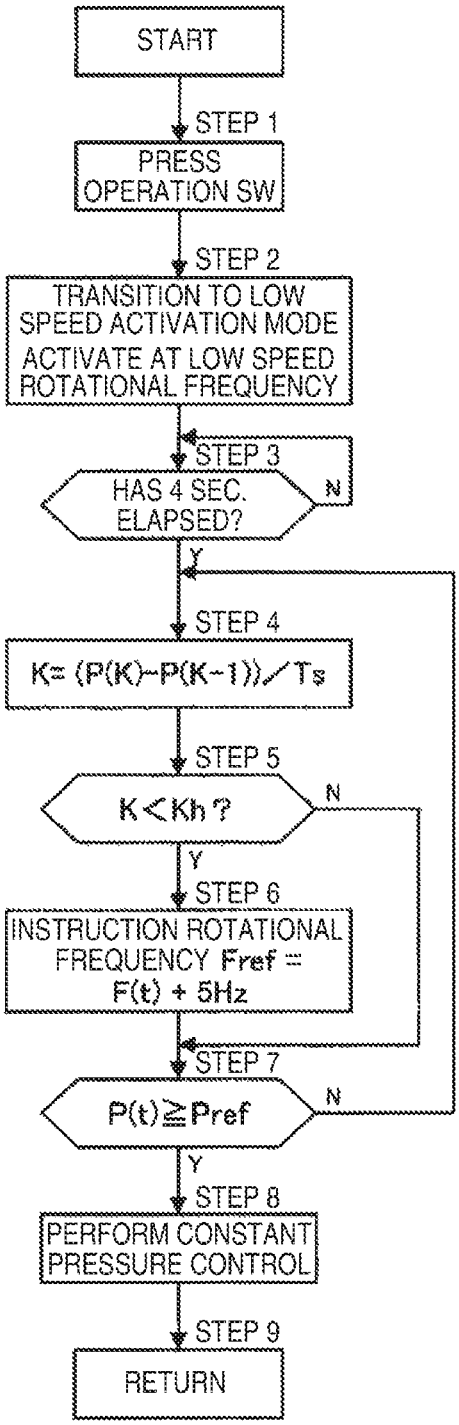
FIG. 8 is a flowchart pertaining to operation mode switching in Embodiment 4.
Figure 9:
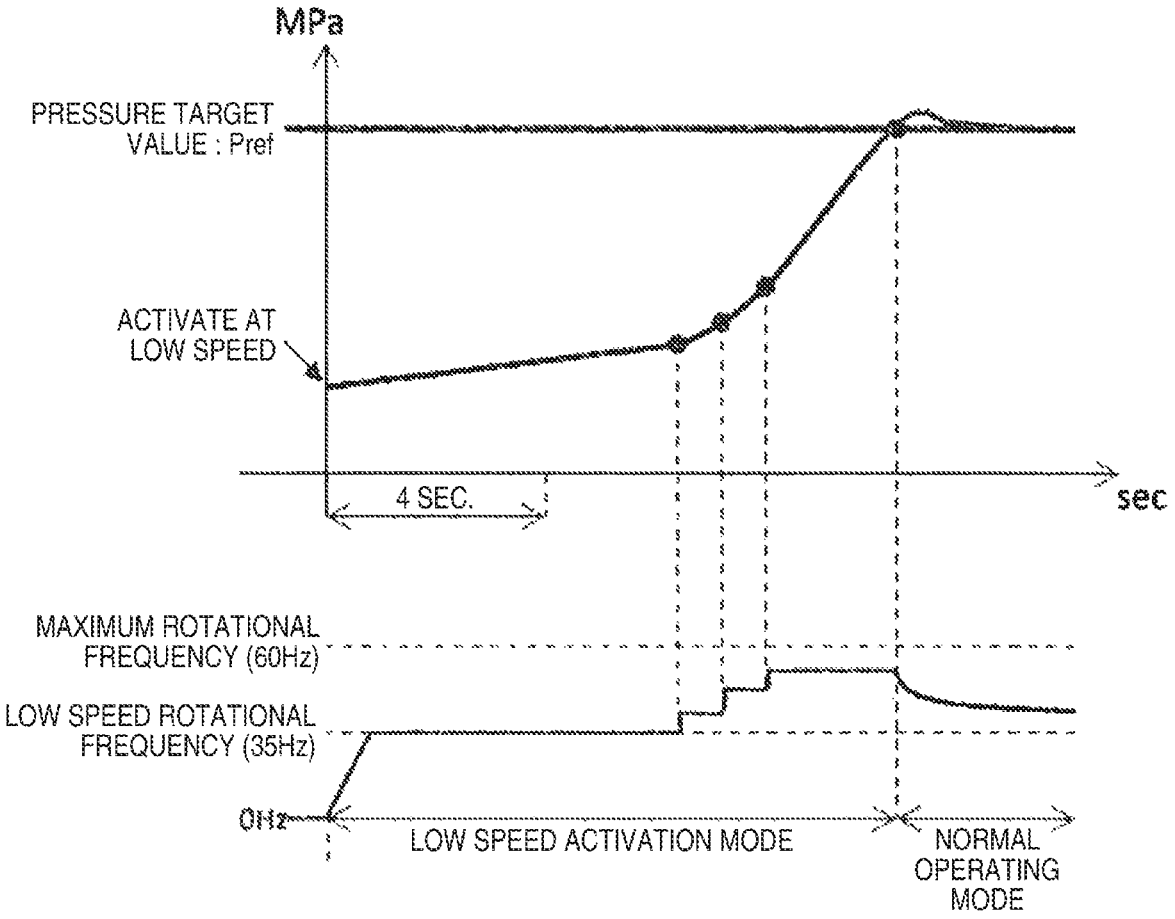
FIG. 9 is a diagram showing change in pressure and operation rate of the compressing apparatus at the initiation of operations in Embodiment 4.

Next, Embodiment 4 of the present invention is hereinafter described. Embodiment 4 assumes a compressing apparatus 1 having a configuration analogous to that of Embodiment 1. The same configuration elements are assigned the same signs. Description of the analogous elements is omitted. FIG. 8 shows a control flow of switching from the low speed activation mode to the normal operating mode at the time of activation of the compressing apparatus 1. FIG. 9 shows change in pressure with respect to the pressure target value Pref and change in the operation rate (operation mode) of the compressing apparatus from activation of the compressing apparatus 1 to transition to the normal operating mode.

In step 1, the operation SW is pressed to activate the compressing apparatus 1. In step 2, the operation transitions to the low speed activation mode, and the compressor body 4 is activated at a low rotational frequency e.g., the minimum rotational frequency 35 Hz). Due to the performance of the inverter, a constant time (e.g., four seconds) is required after activation until the target frequency is reached. Consequently, in step 3, the processing is prevented from transitioning to the next process within the constant time (e.g., four seconds) after activation. After the constant time (e.g., four seconds) has elapsed, the increasing gradient of the pressure becomes stable. Consequently, the processing transitions to step 4. In step 4, the pressure increasing rate K is calculated using (Expression 1) described above. In step 5, it is determined whether the calculated pressure increasing rate K is lower than the predetermined increasing rate threshold Kh. When it is determined as "No", the processing transitions to step 7. When it is determined as "Yes", the processing transitions to step 6. In step 6, an instruction rotational frequency Fref for the inverter 2 is calculated according to the following (Expression 3), and changed.

$$Fref := F(t) + Fn(\text{Hz}) \quad \text{(Expression 3)}$$

Here, Fref: instruction rotational frequency, F(t): current rotational frequency, and Fn: freely selected value (e.g., five).

In step 7, it is determined whether the current pressure P(t) detected by the pressure sensor 6 is at least the target pressure Pref. When it is determined as "No", the processing returns to step 4 after a constant time (e.g., after one second) has elapsed, and the pressure increasing rate K is calculated again. When it is determined as "Yes", the processing transitions to step 8, and the operation is switched to the normal operating mode and returns in step 9.

As to the pressure target value here, even when the pressure reaches a predetermined range (e.g.: within Pref±5%), it may be construed that the pressure reaches the pressure target value Pref.

According to the control flow shown above, the compressing apparatus 1 operates at a low speed at the time of activation, and the operation transitions to the normal operation in the midstream.

As with Embodiment 1, Embodiment 4 can achieve low noise at the time of activation and secure a sufficient air-filling rate to the tank. In comparison with Embodiment 1, Embodiment 4 is characterized in that the speed is gradually increased so that the pressure increasing rate K can be at least the threshold Kh. Thus, in transition from the low speed activation mode to the normal operating mode, the rotation gradually transitions to the maximum rotation. Consequently, advantageous effects are exerted where filling at a rate higher than the required rate is prevented, and the user's discomfort due to change in noise in steep increase from the minimum rotation speed to the maximum rotation speed can be reduced.

In Embodiment 4, the rotation speed is not increased higher than necessary. Consequently, the operation time with low noise becomes relatively longer. The operation is switched to the normal operation at the pressure target value Pref. Consequently, there is no need to operate at the maximum rotation speed, and air filling can be completed with smooth sound.

Next, Embodiment 5 of the present invention is hereinafter described. Embodiment 5 assumes a compressing apparatus 1 having a configuration analogous to that of Embodiment 1 described above. The same configuration elements are assigned the same signs. Description of the analogous elements is omitted.

Figure 10:
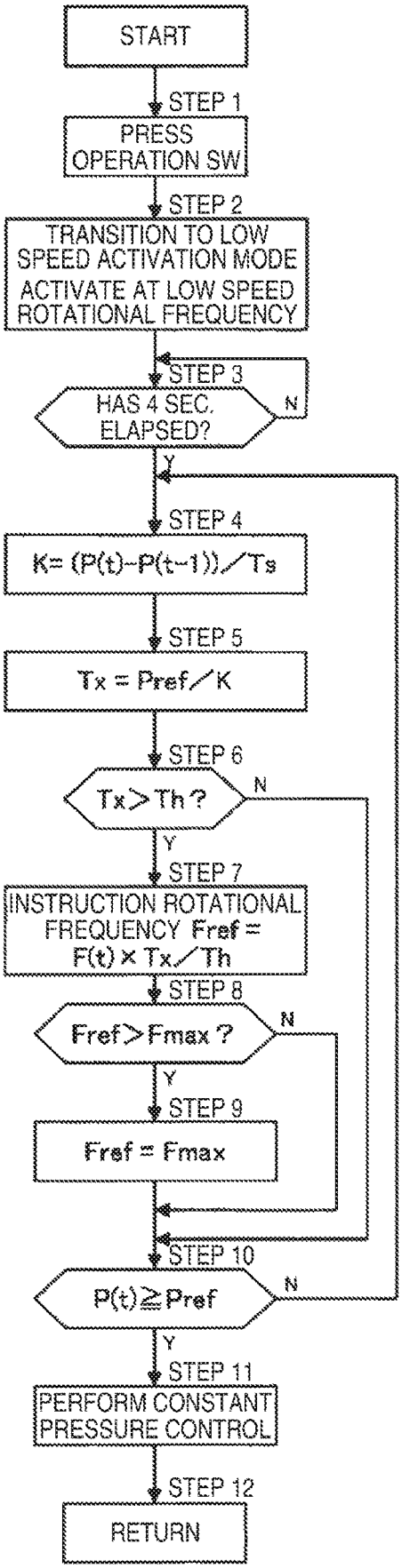
FIG. 10 is a flowchart pertaining to operation mode switching in Embodiment 5.
Figure 11:
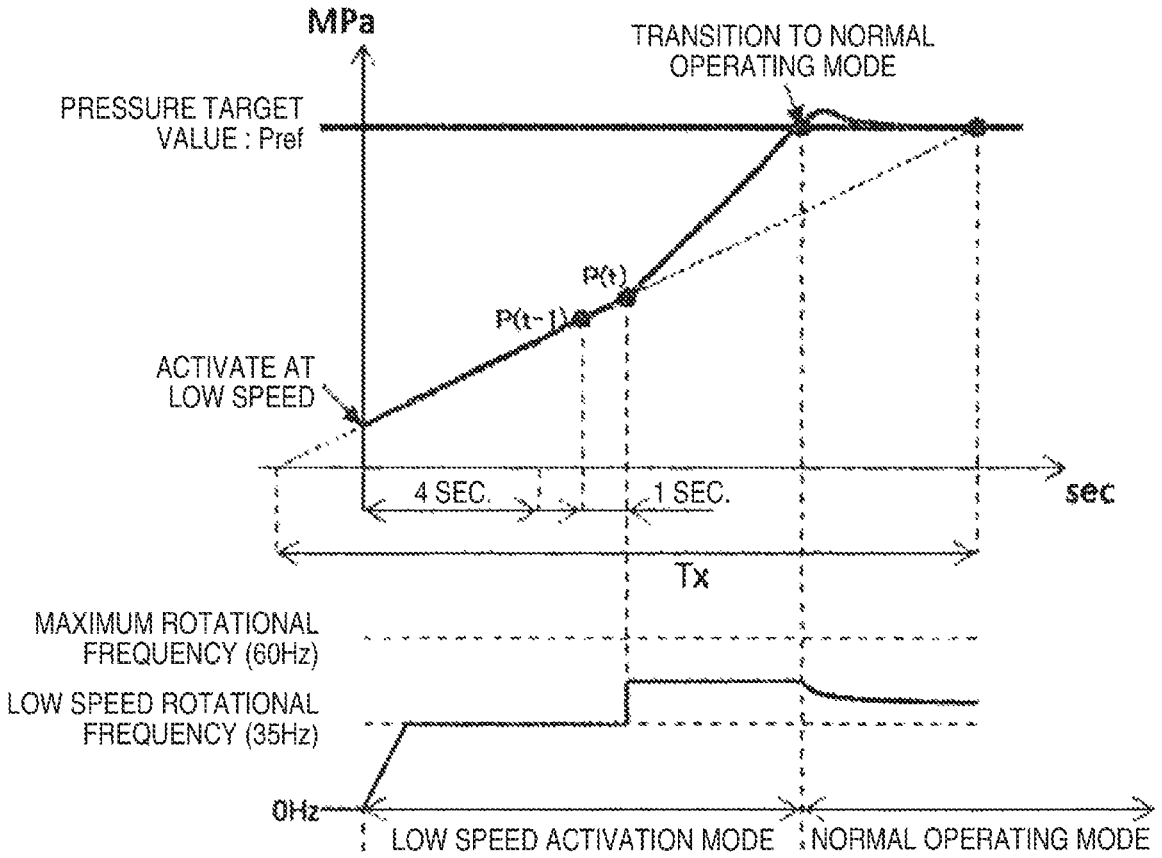
FIG. 11 is a diagram showing change in pressure and operation rate of the compressing apparatus at the initiation of operations in Embodiment 5.

FIG. 10 shows a control flow of switching from the low speed activation mode to the normal operating mode at the time of activation of the compressing apparatus 1. FIG. 11 shows change in pressure with respect to the pressure target value Pref and change in the operation rate (operation mode) of the compressing apparatus from activation of the compressing apparatus 1 to transition to the normal operating mode.

In step 1, the operation SW is pressed to activate the compressing apparatus 1. In step 2, the operation transitions to the low speed activation mode, and the compressor body 4 is activated at a low rotational frequency (e.g., 35 Hz). Due to the performance of the inverter, a constant time (e.g., four seconds) is required after activation until the target frequency is reached. Consequently, in step 3, the processing is prevented from transitioning to the next process until the constant time (e.g., four seconds) elapses after activation. After the constant time (e.g., four seconds) has elapsed, the increasing gradient of the pressure becomes stable. Consequently, the processing transitions to step 4. In step 4, the pressure increasing rate K is calculated using (Expression 1) described above.

In step 5, the control circuit 7 calculates the estimated filling time Tx required for the tank pressure to reach the target value Pref from 0 MPa according to (Expression 2) described above, using the increasing rate K calculated in step 4.

In step 6, the control circuit 7 determines whether the estimated filling time Tx exceeds the preliminarily provided threshold Th. The threshold Th is a target filling time, and can be previously set by the user through the operation panel 8. When it is determined as "No", the low speed operation mode is continued, the low speed operation mode is continued, and the processing transitions to step 10. When it is determined as "Yes" in step 6, the processing transitions to step 7. In step 7, the instruction rotational frequency is obtained according to (Expression 4).

$$\text{Instruction rotational frequency } Fref = F(t) \times Tx/Th \quad \text{(Expression 4)}$$

Here, F(t): current rotational frequency, Tx: estimated filling time, and Th: target filling time.

Next, in step 8, it is determined whether the calculated instruction rotational frequency Fref exceeds the maximum rotational frequency (Fmax). In the case of "Yes", the instruction frequency is corrected to be the maximum rotational frequency in step 9, and the processing transitions to step 10. In the case of "No", the processing transitions to step 10 as it is.

In step 10, it is determined whether the pressure is at least the pressure target value Pref. In the case of "No", the processing returns to step 4 after a constant time has elapsed, and increase in pressure is confirmed again. In the case of "Yes", the processing transition to step 11, and constant pressure control is performed. Finally, in step 12, the processing returns.

In step 10, it is determined whether the pressure is at least the pressure target value Pref in the case of "No", the processing returns to step 4 after the constant time has elapsed, and increase in pressure is confirmed again. In the case of "Yes", the processing transition to step 11, and constant pressure control is performed. Finally, in step 12, the processing returns.

As with Embodiment 2, Embodiment 5 can achieve low noise at the time of activation and secure a sufficient air-filling rate to the tank. In comparison with Embodiment 2, Embodiment 5 is characterized by adjusting the rotational frequency at the low speed operation so as to achieve the target filling time. Thus, in transition from the low speed activation mode to the normal operating mode, the operation is made at the rotation speed equal to or lower than the maximum rotation speed. Consequently, advantageous effects are exerted where filling at a rate higher than the required rate is prevented, and the user's discomfort due to change in noise in steep increase from the minimum rotation speed to the maximum rotation speed can be reduced. In comparison with Embodiment 4, there is another advantageous effect of optimally adjusting the rotation speed in a short time.

In Embodiment 5, the rotation speed is not increased higher than necessary. Consequently, the operation time with low noise becomes relatively longer. The operation is switched to the normal operation at the pressure target value Pref. Consequently, there is no need to operate at the maximum rotation speed, and air filling can be completed with smooth sound.

Next, Embodiment 6 of the present invention is hereinafter described. Embodiment 6 assumes a compressing apparatus 1 having a configuration analogous to that of Embodiment 1 described above. The same configuration elements are assigned the same signs. Description of the analogous elements is omitted.

Figure 12:
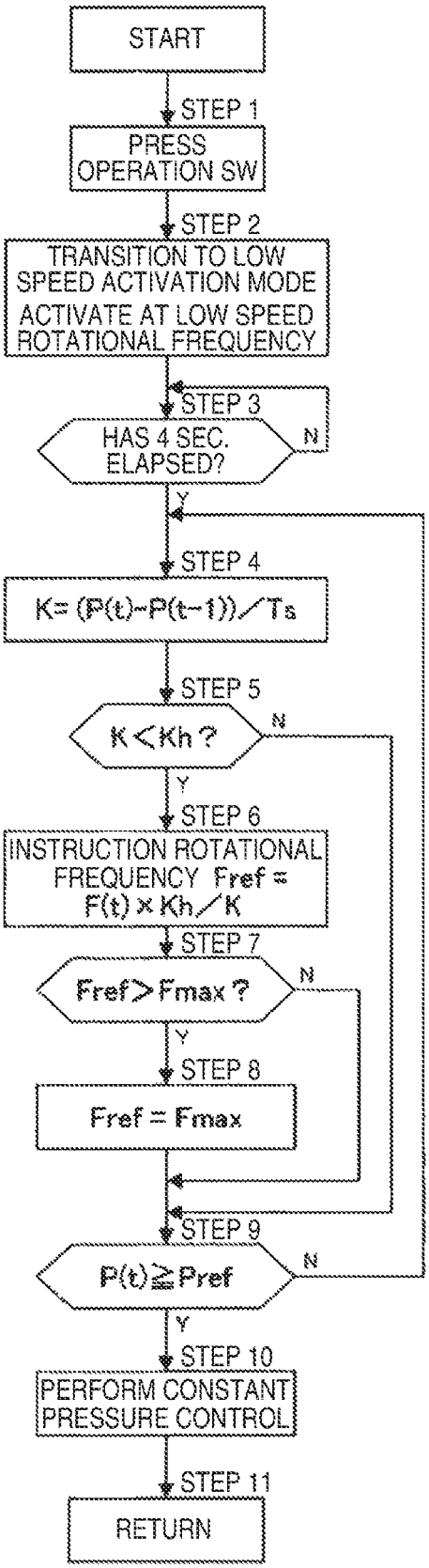
FIG. 12 is a flowchart pertaining to operation mode switching in Embodiment 6.
Figure 13:
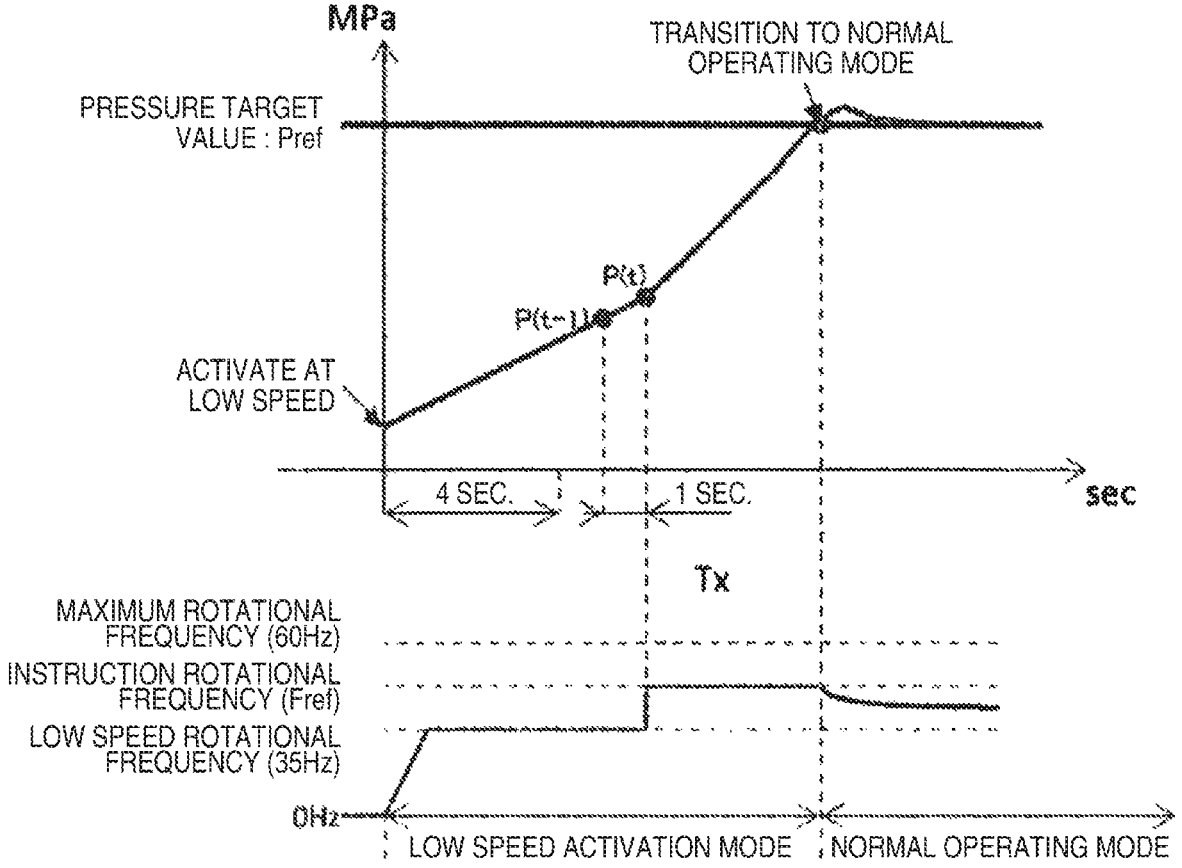
FIG. 13 is a diagram showing change in pressure and operation rate of the compressing apparatus at the initiation of operations in Embodiment 6.

FIG. 12 shows a control flow of switching from the low speed activation mode to the normal operating mode at the time of activation of the compressing apparatus 1. FIG. 13 shows change in pressure with respect to the pressure target value Pref and change in the operation rate (operation mode) of the compressing apparatus from activation of the compressing apparatus 1 to transition to the normal operating mode.

In step 1, the operation SW is pressed to activate the compressing apparatus 1. In step 2, the operation transitions to the low speed activation mode, and the compressor body 4 is activated at a low rotational frequency (e.g., 35 Hz). Due to the performance of the inverter, a constant time (e.g., four seconds) is required after activation until the target frequency is reached. Consequently, in step 3, the processing is prevented from transitioning to the next process until the constant time (e.g., four seconds) elapses after activation. After the constant time (e.g., four seconds) has elapsed, the increasing gradient of the pressure becomes stable. Consequently, the processing transitions to step 4. In step 4, the pressure increasing rate K is calculated using (Expression 1) described above.

In step 5, the control circuit 7 determines whether the pressure increasing rate K is less than a preliminarily provided target value Kh. When it is determined as "No", the low speed operation mode is continued, and the processing transitions to step 9. When it is determined as "Yes" in step 5, the processing transitions to step 6. In step 6, to cause the pressure increasing rate to be the target pressure increasing rate, the instruction rotational frequency Fref for the motor is obtained according to Expression 5.

$$\text{Instruction rotational frequency } Fref = F(t) \times Kh/K \quad \text{(Expression 5)}$$

Here, F(t): current rotational frequency, and Kh: pressure increasing rate target value.

Next, in step 7, it is determined whether the calculated instruction rotational frequency Fref exceeds the maximum rotational frequency (Fmax). In the case of "Yes", the instruction frequency is corrected to be the maximum rotational frequency in step 8, and the processing transitions to step 9. In the case of "No", the processing transitions to step 9 as it is.

In step 9, it is determined whether the pressure is at least the pressure target value Pref. In the case of "No", the processing returns to step 4 after a constant time has elapsed, and increase in pressure is confirmed again. In the case of "Yes", the processing transition to step 10, and constant pressure control is performed. Finally, in step 11, the processing returns.

As with Embodiment 1, Embodiment 6 can achieve low noise at the time of activation and secure a sufficient air-filling rate to the tank. In comparison with Embodiment 1, Embodiment 6 is characterized by adjusting the rotational frequency at the low speed operation so as to satisfy the pressure increasing rate target value. Thus, in transition from the low speed activation mode to the normal operating mode, the operation is made at the rotation speed equal to or lower than the maximum rotation speed. Consequently, advantageous effects are exerted where filling at a rate higher than the required rate is prevented, and the user's discomfort due to change in noise in steep increase from the minimum rotation speed to the maximum rotation speed can be reduced. In comparison with Embodiment 5, calculation can be easily performed, which exert an advantage of simplifying implementation.

In Embodiment 6, the rotation speed is not increased higher than necessary. Consequently, the operation time with low noise becomes relatively longer. The operation is switched to the normal operation at the pressure target value Pref. Consequently, there is no need to operate at the maximum rotation speed, and air filling can be completed with smooth sound.

The invention claimed is:

1. An air compressing apparatus, comprising:

a compressor body compressing air;

a motor driving the compressor body;

an inverter controlling a rotation speed of the motor;

a control circuit connected to the inverter; and a pressure sensor detecting a pressure of the air compressed by the compressor body, wherein the control circuit controls operation of the compressor body in such a way that when the air compressing apparatus is activated, the compressor body is operated in a low speed activation mode in which the compressor body is operated at a low speed rotational frequency lower than a maximum rotation speed, and based on a pressure value detected by the pressure sensor and elapsed time from activation, the low speed activation mode is switched to a normal operating mode in which the compressor body is operated at variable frequencies including a maximum rotational frequency; and wherein, when a pressure change rate calculated based on the pressure value detected by the pressure sensor is lower than a predetermined value, the control circuit switches the low speed activation mode to the normal operating mode based on the pressure change rate.

2. The air compressing apparatus according to claim 1, wherein the control circuit allows switching to the normal operating mode after the elapsed time from activation of the air compressing apparatus until the low speed rotational frequency is reached.

3. A control method of controlling an air compressing apparatus capable of detecting a pressure of compressed air, and controlling a rotation speed of a motor driving a compressor body, wherein the method controls the compressor body in such a way that when the air compressing apparatus is activated, the compressor body is operated in a low speed activation mode in which the compressor body is operated at a low speed rotational frequency lower than a maximum rotation speed, and based on a pressure value detected by the pressure sensor and elapsed time from activation, the low speed activation mode is switched to a normal operating mode in which the compressor body is operated at variable frequencies including a maximum rotational frequency, and wherein, when a pressure change rate calculated based on the detected pressure value is lower than a predetermined value, the low speed activation mode is switched to the normal operating mode based on the pressure change rate.

4. The control method according to claim 3, wherein switching is allowed to the normal operating mode after the elapsed time from activation of the air compressing apparatus to until the low speed rotational frequency is reached.

5. The air compressing apparatus according to claim 1, wherein the low speed activation mode is switched to the normal operating mode in which the compressor body is operated at variable frequencies including a maximum rotational frequency such that the pressure value detected by the pressure sensor reaches or maintains a predetermined pressure target value within a predetermined range, wherein the control circuit is configured to control operation of the compressor body to have a minimum rotational frequency when the pressure value detected by the pressure sensor exceeds an upper limit of the predetermined range.

6. The control method according to claim 3, wherein the low speed activation mode is switched to the normal operating mode in which the compressor body is operated at variable frequencies including a maximum rotational frequency such that the pressure value detected by the pressure sensor reaches or maintains a predetermined pressure target value within a predetermined range, wherein the control circuit is configured to control operation of the compressor body to have a minimum rotational frequency when the pressure value detected by the pressure sensor exceeds an upper limit of the predetermined range.

* * * * *